US006142895A

United States Patent [19]

Jason

[11] Patent Number: 6,142,895

[45] Date of Patent: Nov. 7, 2000

[54] ARROW WITH MARKING HEAD

[76] Inventor: George J. Jason, 130 Oak Knoll Dr., Cleveland, Ga. 30528

[21] Appl. No.: 09/385,427

[22] Filed: Aug. 30, 1999

[51] Int. Cl.[7] ..... F42B 6/04

[52] U.S. Cl. ..... 473/577; 473/578

[58] Field of Search ..... 473/577, 578, 473/581, 582, FOR 216, FOR 218, FOR 219; 102/513

[56] References Cited

U.S. PATENT DOCUMENTS

| | | | |
|---|---|---|---|
| 735,415 | 8/1903 | Schrodel | 473/574 |
| 1,545,476 | 7/1925 | Austerman | 473/578 |
| 1,920,257 | 8/1933 | Halland | 473/577 X |
| 3,190,654 | 6/1965 | Ross | 473/577 X |
| 3,528,662 | 9/1970 | Merchant et al. | 473/577 |
| 5,669,836 | 9/1997 | Hill | 473/574 |
| 5,711,284 | 1/1998 | Kennan, Jr. | 124/49 |

FOREIGN PATENT DOCUMENTS

| | | |
|---|---|---|
| 333797 | 12/1903 | France . |
| 351053 | 3/1907 | France . |

*Primary Examiner*—John A. Ricci
*Attorney, Agent, or Firm*—Stephen R. Greiner

[57] ABSTRACT

An arrow having an elongated shaft with opposed ends. A slotted nock and fletching are affixed to one end of the shaft. A marking head having a paint ball is attached to the other end of the shaft.

8 Claims, 1 Drawing Sheet

ARROW WITH MARKING HEAD

FIELD OF THE INVENTION

The present invention relates generally to arrows, darts, shuttlecocks and parts thereof.

BACKGROUND OF THE INVENTION

It has been estimated that there are four million bow hunters in the United States today. Most of these hunters pursue game as a recreational activity with little desire to take the life of a game animal. State of the art bows and arrows, however, make average bow hunters into proficient killers capable of depleting existing game stocks.

Many individuals have come to believe that the "catch and release" tactics long employed by fishermen can be applied to bow hunting to maintain a game animal's population at relatively high levels and enhance the hunting experience. Arrows which mark, but do not kill, an animal have been proposed to obtain "catch and release" encounters with game animals. Unfortunately, these arrows have been cumbersome to use thereby limiting their acceptance.

SUMMARY OF THE INVENTION

In light of the limitations associated with the known bow hunting equipment, it is a principal object of the invention to provide an easy-to-use arrow which will leave a mark upon a target rather than penetrating such. Thus, a hunter using the inventive arrow may experience the excitement of stalking and shooting at game without anxiety that his actions will deplete a wild resource.

It is another object of the invention to provide an arrow of the type described which, after recharging, is reusable.

It is an object of the invention to provide improved elements and arrangements thereof in an arrow for the purposes described which is lightweight in construction, inexpensive to manufacture, and dependable in use.

Briefly, the arrow in accordance with this invention achieves the intended objects by featuring an elongated shaft with opposed ends. A slotted nock and fletching are affixed to one end of the elongated shaft. A marking head having a rupturable paint ball filled with a high-visibility, water-soluble paint is attached to the other end of the elongated shaft.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
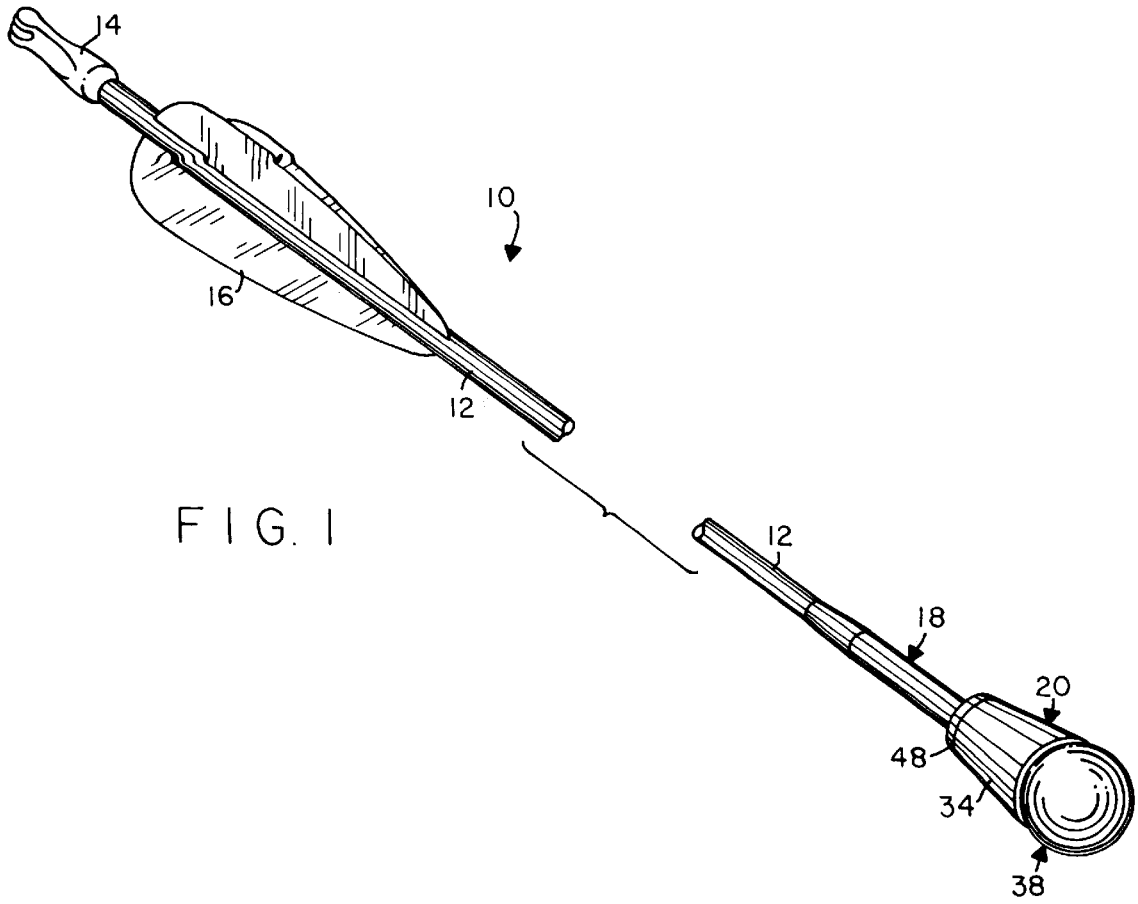
FIG. 1 is a perspective view of an arrow in accordance with the present invention.
Figure 2:
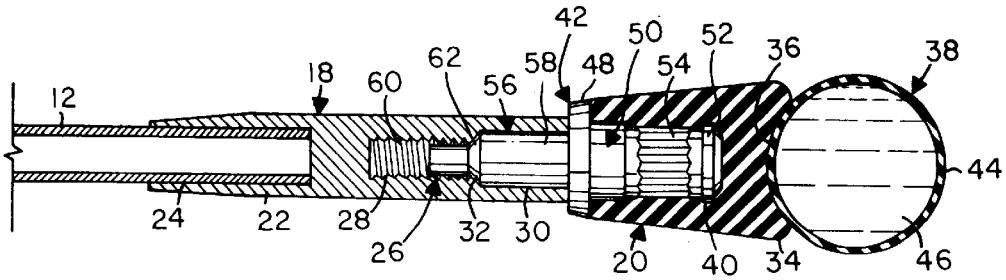
FIG. 2 is an enlarged, longitudinal, cross-sectional view of the marking head of the arrow of FIG. 1.

Referring now to the FIGS., an arrow in accordance with the present invention is shown at 10. Arrow 10 includes an elongated shaft 12 having a slotted nock 14 and fletching 16 affixed to one of its ends and an outsert 18 affixed to the other of its ends for the selective attachment of a marking head 20. In use, arrow 10 will mark a target rather than penetrate it.

The preferred shaft 12 comprises a tube formed of carbon fiber composite. Such shafts are known for their durability and lightness as well as the great precision and consistency with which they may be shot. Alternative materials such as wood, fiberglass and aluminum may be used to form shaft 12 but such are not as light or as durable as carbon fiber.

Fletching 16 comprises three plastic vanes or feathers which cause arrow 10 to spin thereby providing stability and accuracy in flight. Plastic vanes are heavier than feathers, causing arrow 10 to travel somewhat slower when shot, but they are more durable. Also, plastic vanes absorb no water from the air like feathers which can cause inconsistency in shooting.

Outsert 18 includes a metallic rod 22 with apertures 24 and 26 in its opposite ends. Within aperture 24, one end of shaft 12 is glued. The other aperture 26 has an threaded inner segment 28 connected to an outer segment 30 of relatively larger diameter by a shoulder 32 for screwed attachment of head 20.

The head 20 includes a cylindrical plug 34 formed of hard rubber or plastic. The plug 34 has a concavity 36 in its front end within which a paint ball 38 is seated and affixed by means of a suitable adhesive. Opposite concavity 36, a bore 40 is provided in the rear end of plug 34 for engagement with a connector 42.

The paint ball 38 has a spherical shell 44 formed of a resilient plastic material. The shell 44 contains a quantity of liquid paint 46 which is preferably water soluble and has a color that is easily seen at a distance. Upon impact with a target, the shell 44 will rupture, emitting paint 46 and marking the target.

Connector 42 has a supporting disk 48 which abuts the rear end of plug 34. Extending forwardly from disk 48 is a retaining pin 50 adapted for insertion into bore 40. The pin 50 has a flared end 52 and longitudinal fins 54 which prevent its ready withdrawal from, or rotation within, plug 34. (An adhesive on pin 50 may further bond plug 34 and connector 42 together.) An attaching pin 56 extends rearwardly from disk 48 and has a relatively large-diameter reinforcing portion 58 with a threaded stem portion 60 projecting therefrom. In use, stem portion 60 is threaded into aperture 26 until the conical end wall 62 butts snugly against shoulder 32.

Use of arrow 10, is like that of conventional arrows. First, nock 14 is engaged with a bow string (not shown). Next, the bow string is drawn back and arrow 10 is aimed. Finally, the bow string is released propelling arrow 10 toward a target. If the target is solidly hit, paint ball 38 will rupture thereby releasing paint 46 and marking the target. If the target is missed and arrow 10 lands in brush, grass or leaves, thereby avoiding an impact with an unyielding object, paint ball 38 will not rupture and arrow 10 may be immediately reused.

Arrow 10 having a ruptured paint ball shell 44 can be reused. To accomplish this, excess paint 46 is first rinsed off arrow 10 by running water. Then, shell 44 is pulled from plug 34 and discarded. Finally, a new paint ball 38 is seated in concavity 36 and adhered there by a dab of suitable adhesive. When the adhesive has dried, arrow 10 is ready for reuse.

While the invention has been described with a high degree of particularity, it will be appreciated by those skilled in the art that modifications may be made thereto. Thus, it is to be understood that the present invention is not limited to the sole embodiment described above, but encompasses any and all embodiments within the scope of the following claims.

I claim:

1. An arrow, comprising:

an elongated shaft having opposed, first and second ends;

a slotted nock affixed to said first end of said elongated shaft;

fletching affixed to said elongated shaft adjacent said slotted nook;

an outsert affixed to said second end of said elongated shaft; and a marking head having a paint ball, threadably attached to said outsert.

2. The arrow according to claim 1 wherein said elongated shaft comprises a tube formed of a carbon fiber composite material.

3. The arrow according to claim 1 wherein said fletching comprises a plurality of plastic fins.

4. The arrow according to claim 1 wherein said paint ball is filled with a high-visibility, water-soluble paint.

5. An arrow, comprising:

an elongated shaft having opposed, first and second ends;

a slotted nock affixed to said first end of said elongated shaft;

fletching affixed to said elongated shaft adjacent said slotted nock;

an outsert affixed to said second end of said elongated shaft;

a marking head threadably attached to said outsert, said marking head including:

a plug formed of a resilient material and having a front end and a rear end, said plug having concavity in said front end thereof and a bore in said rear end thereof;

a paint ball filled with liquid paint, said paint ball being seated within said concavity in said plug and adhesively attached to said plug; and, a threaded connector projecting from said bore in said plug for threaded attachment to said outsert.

6. A marking head for an arrow, comprising:

a plug formed of a resilient material and having a front end and a rear end, said plug having concavity in said front end thereof and a bore in said rear end thereof;

a paint ball having a rupturable, spherical shell filled with liquid paint, said spherical shell being seated within said concavity in said plug and being adhesively attached to said plug; and, a threaded connector projecting from said bore, said threaded connector including:

a supporting disk abutting said rear end of said plug;

a retaining pin extending forwardly from said supporting disk into said bore in said plug, said retaining pin having a flared end and longitudinal fins; and, an attaching pin extending rearwardly from said supporting disk, said attaching pin having a relatively large-diameter reinforcing portion positioned adjacent said supporting disk and a threaded stem portion projecting from said reinforcing portion.

7. The marking head according to claim 6 wherein said plug is formed of hard rubber.

8. The marking head according to claim 6 wherein said liquid paint is water-soluble.

* * * * *